US010329797B2

(12) United States Patent
Huang et al.

(10) Patent No.: US 10,329,797 B2
(45) Date of Patent: Jun. 25, 2019

(54) LOCK SET TRANSMISSION MECHANISM

(71) Applicant: TAIWAN FU HSING INDUSTRIAL CO., LTD., Kaohsiung (TW)

(72) Inventors: Chao-Ming Huang, Kaohsiung (TW); Chi-Ming Chen, Kaohsiung (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 0 days.

(21) Appl. No.: 15/846,228

(22) Filed: Dec. 19, 2017

(65) Prior Publication Data

US 2018/0313114 A1 Nov. 1, 2018

(30) Foreign Application Priority Data

Apr. 28, 2017 (TW) ..... 106114222 A

(51) Int. Cl.
*E05B 27/00* (2006.01)
*E05B 63/00* (2006.01)
*E05B 17/04* (2006.01)

(52) U.S. Cl.
CPC ..... *E05B 27/0003* (2013.01); *E05B 17/041* (2013.01); *E05B 27/0007* (2013.01); *E05B 63/0056* (2013.01)

(58) Field of Classification Search
CPC .. E05B 27/0003; E05B 27/0007; E05B 17/04; E05B 17/041
USPC ..... 70/370–373, 379 R, 379 A, 380
See application file for complete search history.

(56) References Cited

U.S. PATENT DOCUMENTS 1,564,463 A * 12/1925 Best ..... E05B 17/04 70/357
2,042,025 A * 5/1936 Schlage ..... E05B 63/0017 70/224
2,213,262 A * 9/1940 Segal ..... E05B 17/041 70/379 R
2,642,735 A * 6/1953 Quigley ..... E05B 55/005 70/380
2,720,408 A * 10/1955 Krupicka ..... E05C 1/163 292/150
3,046,777 A * 7/1962 Schlage ..... E05B 3/003 70/224

(Continued)

FOREIGN PATENT DOCUMENTS

CN 201284574 Y 8/2009
TW 405636 9/2000

(Continued)

*Primary Examiner* — Suzanne L Barrett
(74) *Attorney, Agent, or Firm* — Winston Hsu

(57) ABSTRACT

A lock set transmission mechanism includes a lock case, a lock core, a transmission rod, a supporting member and a fixing member. The lock core is arranged on the lock case and configured to be driven by a key to rotate relative to the lock case. The transmission rod has a first end configured to be connected to a latch, and a second end. The supporting member includes a first supporting ring sleeved on the lock core, a second supporting ring configured to support the second end of the transmission rod, and at least one supporting rib connected to the first and second supporting rings. The fixing member is configured to fix the supporting member to the lock core. Wherein, when the lock core is rotated relative to the lock case, the transmission rod is driven by the lock core to rotate, in order to move the latch.

12 Claims, 20 Drawing Sheets

(56) References Cited

U.S. PATENT DOCUMENTS 3,286,773 A * 11/1966 Russell ..... E05B 9/084 70/224
3,404,549 A * 10/1968 Best ..... E05B 9/04 70/370
3,434,316 A * 3/1969 Neary ..... E05B 9/086 70/368
4,068,510 A * 1/1978 Neary ..... E05B 9/105 70/379 R
4,123,926 A * 11/1978 Elder ..... E05B 9/086 70/369
6,109,080 A * 8/2000 Chen ..... E05B 9/084 70/215
6,540,274 B2 * 4/2003 Bates ..... E05C 1/163 292/169.23
6,634,196 B2 * 10/2003 Huang ..... E05B 55/005 292/169.17
6,644,076 B2 * 11/2003 Huang ..... E05B 17/04 70/367
6,837,083 B2 * 1/2005 Katagiri ..... E05B 17/041 70/367
6,854,306 B2 * 2/2005 Furlong ..... E05B 17/04 70/367
6,883,356 B1 * 4/2005 Wu ..... E05B 9/086 70/372
7,357,010 B1 * 4/2008 Huang ..... E05B 17/04 70/379 R
7,536,887 B2 * 5/2009 Makino ..... E05B 17/04 70/370
7,895,865 B2 * 3/2011 Hartman ..... E05B 17/04 70/1.5
7,895,867 B2 * 3/2011 Hsieh ..... E05B 17/04 70/372
8,127,579 B2 * 3/2012 Mannella ..... E05B 9/086 70/367
8,316,676 B2 * 11/2012 Chiang ..... E05B 17/0062 70/379 R
2001/0023600 A1 * 9/2001 Pompeii ..... E05B 55/005 70/224
2006/0086162 A1 * 4/2006 Huang ..... E05B 9/084 70/224
2006/0208507 A1 * 9/2006 Huang ..... E05B 63/006 292/336.3

FOREIGN PATENT DOCUMENTS

TW M272835 8/2005
TW I457493 B 10/2014

* cited by examiner

LOCK SET TRANSMISSION MECHANISM

BACKGROUND OF THE INVENTION

1. Field of the Invention

The present invention relates to a lock set transmission mechanism, and more particularly, to a lock set transmission mechanism allowing a lock core to cooperate with different transmission rods.

2. Description of the Prior Art

Generally, a lock core of a lock set is connected to a latch through a transmission rod. When the lock core of the lock set is driven by a key to rotate, the lock core drives the latch to move between an unlocked position and a locked position through the transmission rod, in order to perform unlocking or locking operation. However, in different types of lock sets, the transmission rods have different structures. The lock core is required to be arranged with a corresponding driving structure to drive the transmission rod to rotate. The lock core of the lock set of the prior art cannot cooperate with different transmission rods. Therefore, the lock set of the prior art has less design flexibility and production efficiency.

SUMMARY OF THE INVENTION

The present invention provides a lock set transmission mechanism, comprising a lock case, a lock core, a transmission rod, a supporting member and a fixing member. The lock core is arranged on the lock case and configured to be driven by a key to rotate relative to the lock case. The transmission rod has a first end and a second end. The first end of the transmission rod is configured to be connected to a latch. The supporting member comprises a first supporting ring sleeved on the lock core, a second supporting ring configured to support the second end of the transmission rod, and at least one supporting rib connected to the first supporting ring and the second supporting ring. The fixing member is configured to fix the supporting member to the lock core. Wherein, when the lock core is rotated relative to the lock case, the transmission rod is driven by the lock core to rotate, in order to move the latch.

In one embodiment of the present invention, a groove is formed on the lock core, the fixing member is a C-shaped ring engaged with the groove and abutting against the first supporting ring.

In one embodiment of the present invention, at least one recessed structure is formed on the lock core, the at least one supporting rib is accommodated in the at least one recessed structure.

In one embodiment of the present invention, a driving structure is formed on the second supporting ring of the supporting member, and configured to drive the transmission rod to synchronously rotate with the lock core.

In one embodiment of the present invention, a driving structure is formed on the second supporting ring of the supporting member, and configured to drive the transmission rod to rotate after the lock core is rotated relative to the lock case by a predetermined angle.

In one embodiment of the present invention, a pushed structure is formed on the second end of the transmission rod, a pushing structure is formed on the lock core; when the lock core is rotated relative to the lock case, the pushing structure of the lock core abuts against the pushed structure of the transmission rod to further drive the transmission rod to rotate.

In one embodiment of the present invention, the lock set transmission mechanism further comprises a washer arranged on the lock core, wherein a pushed structure is formed on the second end of the transmission rod, a pushing structure is formed on the washer; when the lock core is rotated relative to the lock case, the pushing structure of the washer abuts against the pushed structure of the transmission rod to further drive the transmission rod to rotate.

In one embodiment of the present invention, a pushed structure is formed on the second end of the transmission rod, a pushing structure is formed on the supporting member; when the lock core is rotated relative to the lock case, the pushing structure of the supporting member abuts against the pushed structure of the transmission rod to further drive the transmission rod to rotate.

In one embodiment of the present invention, the pushing structure of the supporting member is extended from the second supporting ring to be inserted into the lock core.

In one embodiment of the present invention, the pushing structure of the supporting member is extended from the second supporting ring, and orthogonal projection of the pushing structure on the lock core overlaps orthogonal projection of the second supporting ring on the lock core.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
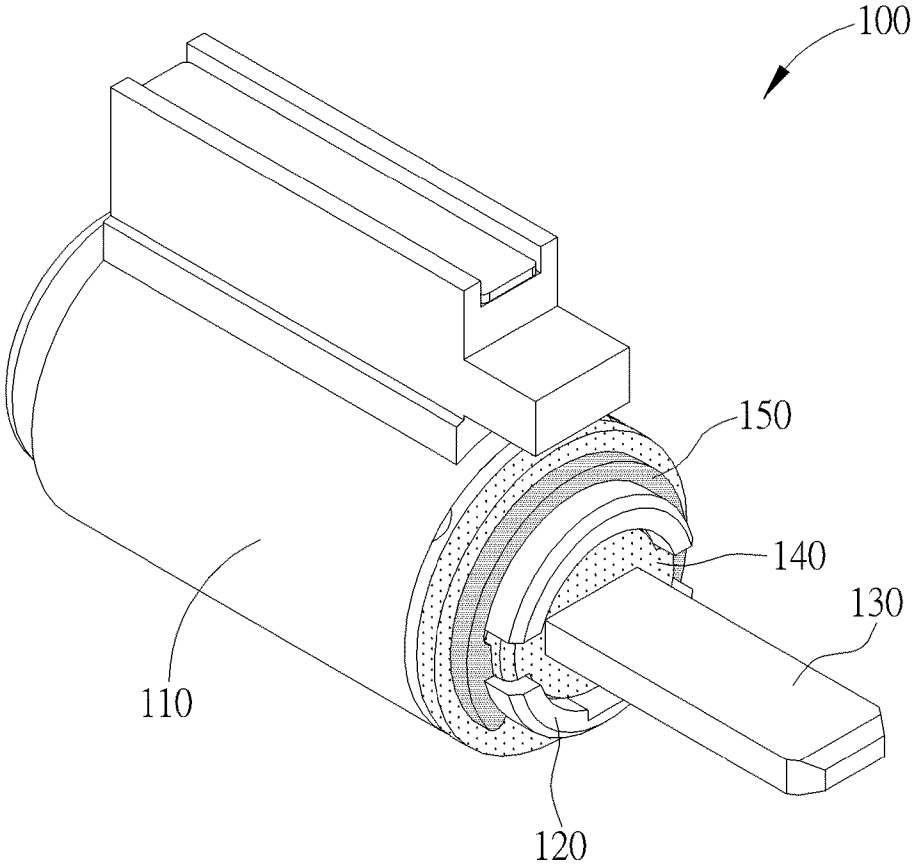
FIG. 1 is a diagram showing a first embodiment of a lock set transmission mechanism of the present invention.
Figure 2:
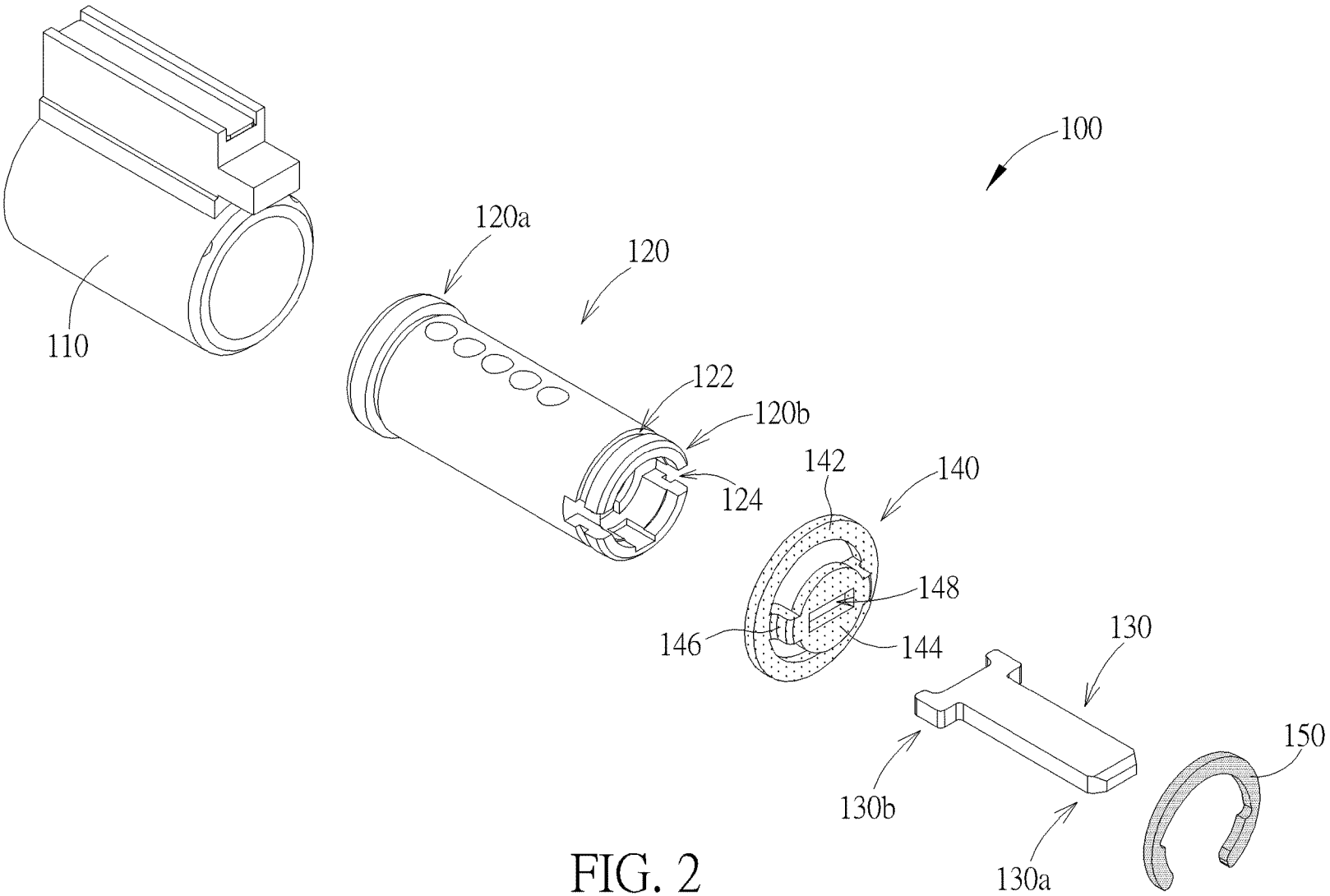
FIG. 2 is an exploded view of the first embodiment of the lock set transmission mechanism of the present invention.

Please refer to FIG. 1 and FIG. 2. FIG. 1 is a diagram showing a first embodiment of a lock set transmission mechanism of the present invention. FIG. 2 is an exploded view of the first embodiment of the lock set transmission mechanism of the present invention. As shown in figures, the first embodiment 100 of the lock set transmission mechanism of the present invention comprises a lock case 110, a lock core 120, a transmission rod 130, a supporting member 140 and a fixing member 150. The lock core 120 is arranged on the lock case 110. A first end 120*a* of the lock core 120 is provided with a key hole (not shown in figures). When a corresponding key is inserted into the key hole of the first end 120*a* of the lock core 120, the lock core 120 can be driven by the key to rotate relative to the lock case 110. In the present embodiment, the transmission rod 130 is applicable to a C-type lock (cylindrical lock). A first end 130*a* of the transmission rod 130 is configured to be connected to a latch (not shown in figures). When the transmission rod 130 is rotated, the transmission rod 130 can drive the latch to move between an unlocked position and a locked position, in order to perform unlocking or locking operation. The supporting member 140 comprises a first supporting ring 142, a second supporting ring 144 and at least one supporting rib 146. The first supporting ring 142 is sleeved on a second end 120*b* of the lock core 120. The second supporting ring 144 is configured to support a second end 130*b* of the transmission rod 130. In the present embodiment, the supporting member 140 comprises two supporting ribs 146 connected to the first supporting ring 142 and the second supporting ring 144. The fixing member 150 is configured to fix the supporting member 140 to the second end 120*b* of the lock core 120. In the present embodiment, a groove 122 is formed on the lock core 120, and the fixing member 150 is a C-shaped ring configured to be engaged in the groove 122. When the fixing member 150 is engaged in the groove 122, the fixing member 150 abuts against the first supporting ring 142 for fixing the supporting member 140 to the second end 120*b* of the lock core 120.

In addition, recessed structures 124 are formed on the lock core 120. Each of the supporting ribs 146 can be accommodated in the corresponding recessed structure 124. As such, when the lock core 120 is rotated relative to the lock case 110, the lock core 120 can drive the supporting member 140 to synchronously rotate through the supporting ribs 146. The number of the recessed structures 124 and the number of the supporting ribs 146 can be changed according to requirements. Moreover, a driving structure 148 is formed on the second supporting ring 144 of the supporting member 140 for driving the transmission rod 130 to synchronously rotate with the supporting member 140. In other words, when the lock core 120 is rotated relative to the lock case 110, the transmission rod 130 is synchronously rotated with the lock core 120, in order to move the latch.

Figure 3:
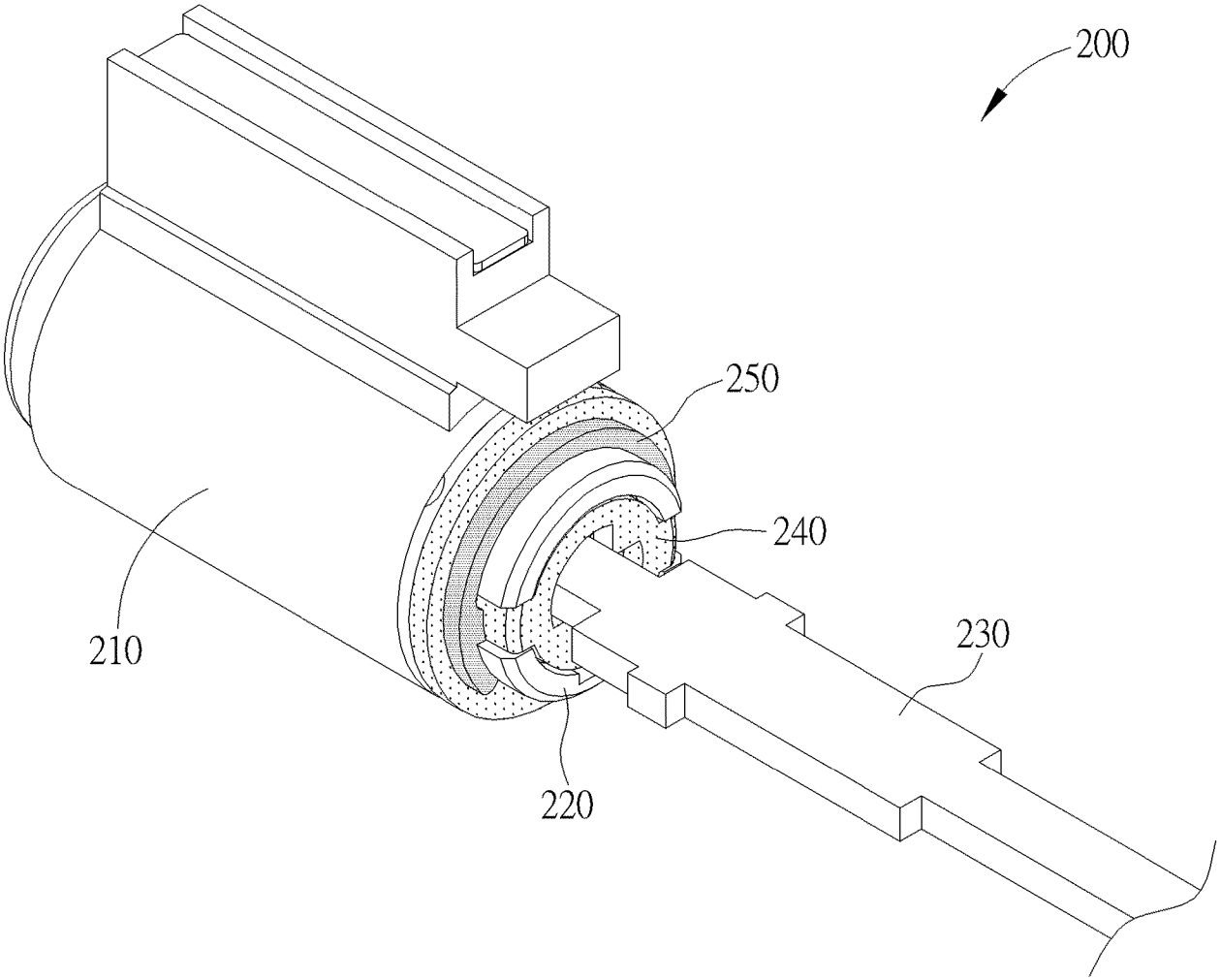
FIG. 3 is a diagram showing a second embodiment of the lock set transmission mechanism of the present invention.
Figure 4:
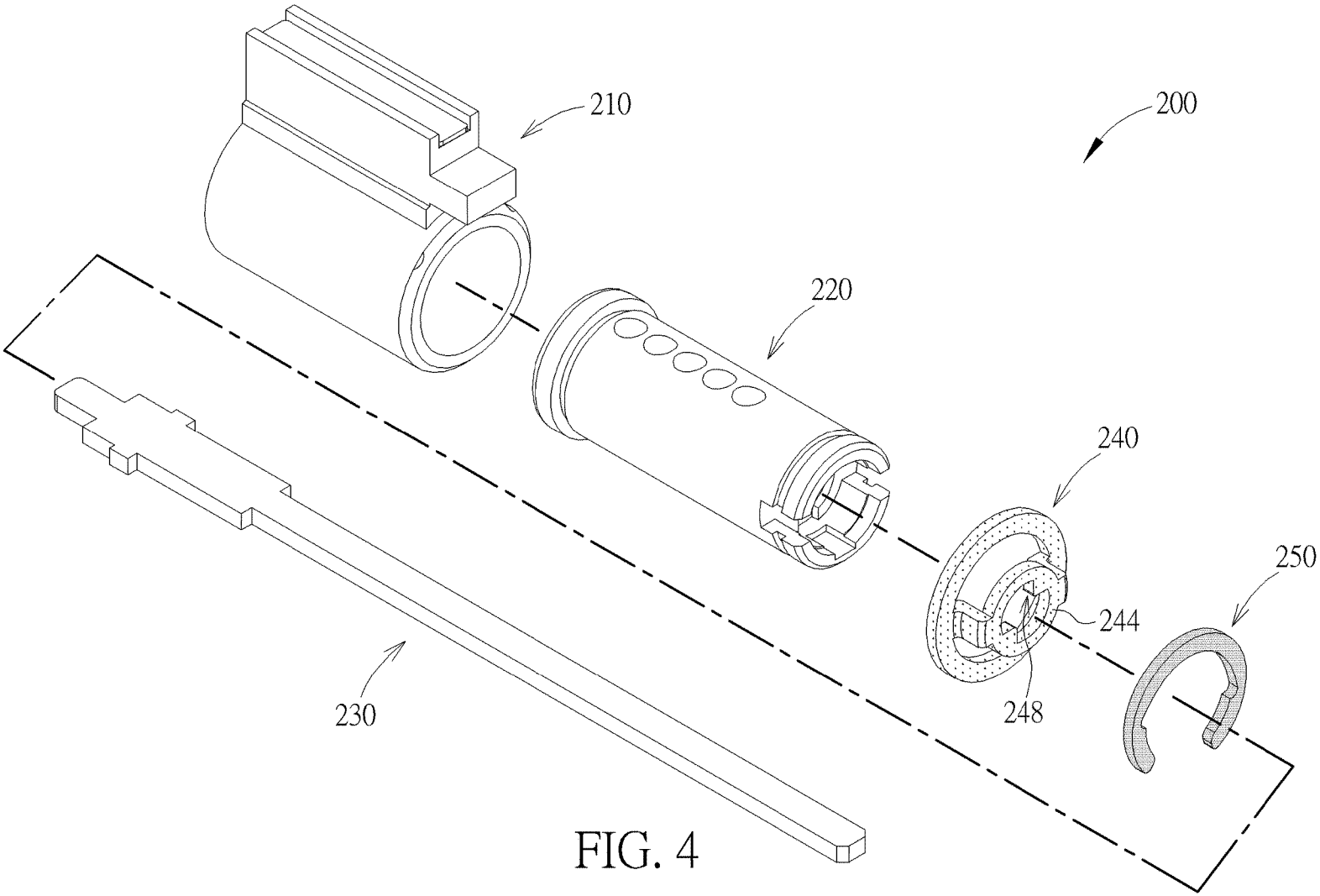
FIG. 4 is an exploded view of the second embodiment of the lock set transmission mechanism of the present invention.

Please refer to FIG. 3 and FIG. 4. FIG. 3 is a diagram showing a second embodiment of the lock set transmission mechanism of the present invention. FIG. 4 is an exploded view of the second embodiment of the lock set transmission mechanism of the present invention. As shown in figures, the second embodiment 200 of the lock set transmission mechanism of the present invention comprises a lock case 210, a lock core 220, a transmission rod 230, a supporting member 240 and a fixing member 250. The lock case 210, the lock core 220, and the fixing member 250 of the second embodiment 200 of the lock set transmission mechanism of the present invention are similar to the lock case 110, the lock core 120, and the fixing member 150 of the first embodiment 100 of the lock set transmission mechanism of the present invention. Therefore, no further illustration is provided. In the present embodiment, the transmission rod 230 is applicable to a T-type lock (knob lock). Similarly, the supporting member 240 can be synchronously rotated with the lock core 220. In addition, a driving structure 248 is formed on a second supporting ring 244 of the supporting member 240 for driving the transmission rod 230 to rotate after the supporting member 240 is rotated relative to the transmission rod 230 by a predetermined angle (such as being rotated by 180 degrees counterclockwise). In other words, after the lock core 220 is rotated relative to the lock case 210 by the predetermined angle, the driving structure 248 of the supporting member 240 is configured to drive the transmission rod 230 to rotate, in order to move the latch.

Figure 5:
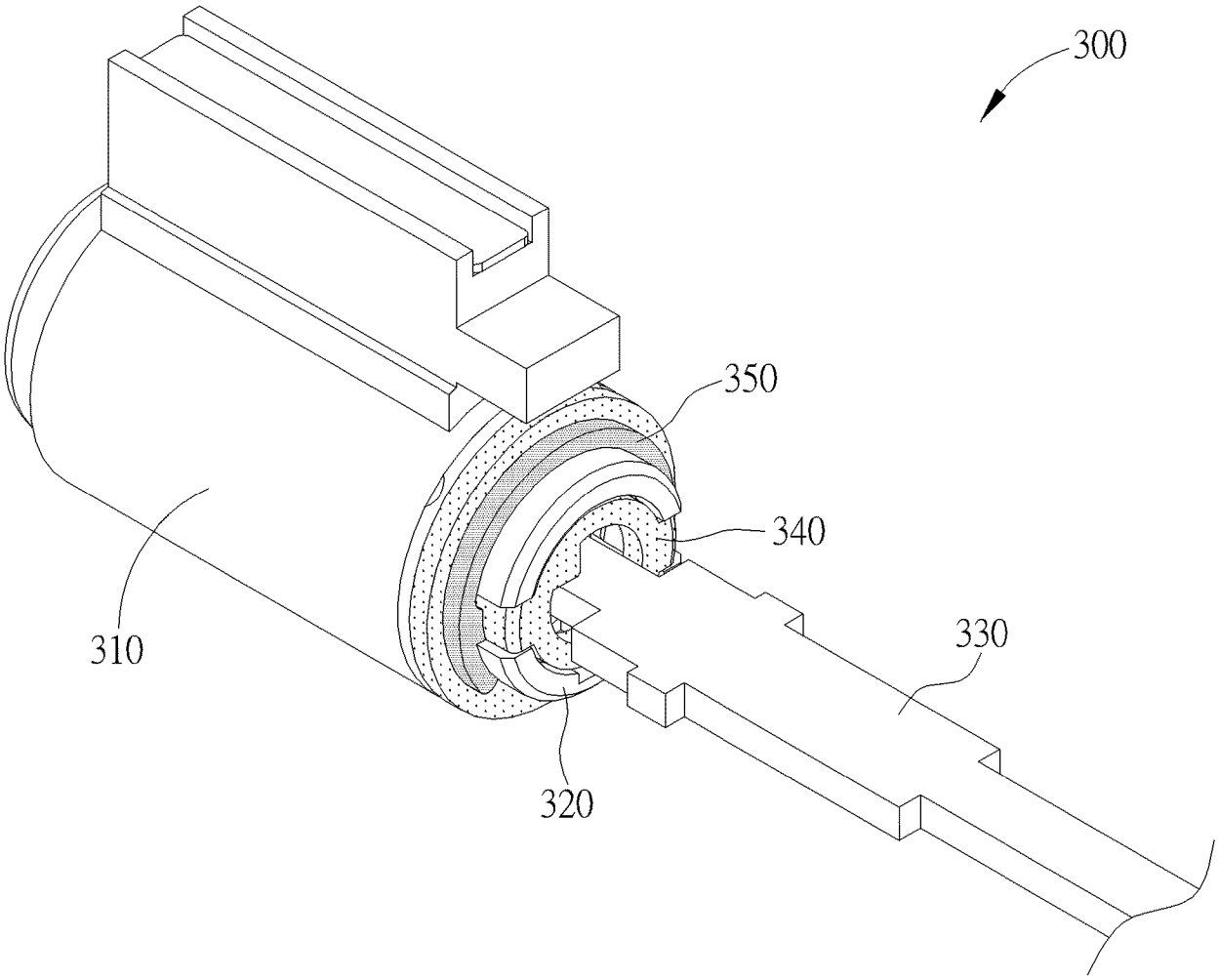
FIG. 5 is a diagram showing a third embodiment of the lock set transmission mechanism of the present invention.
Figure 6:
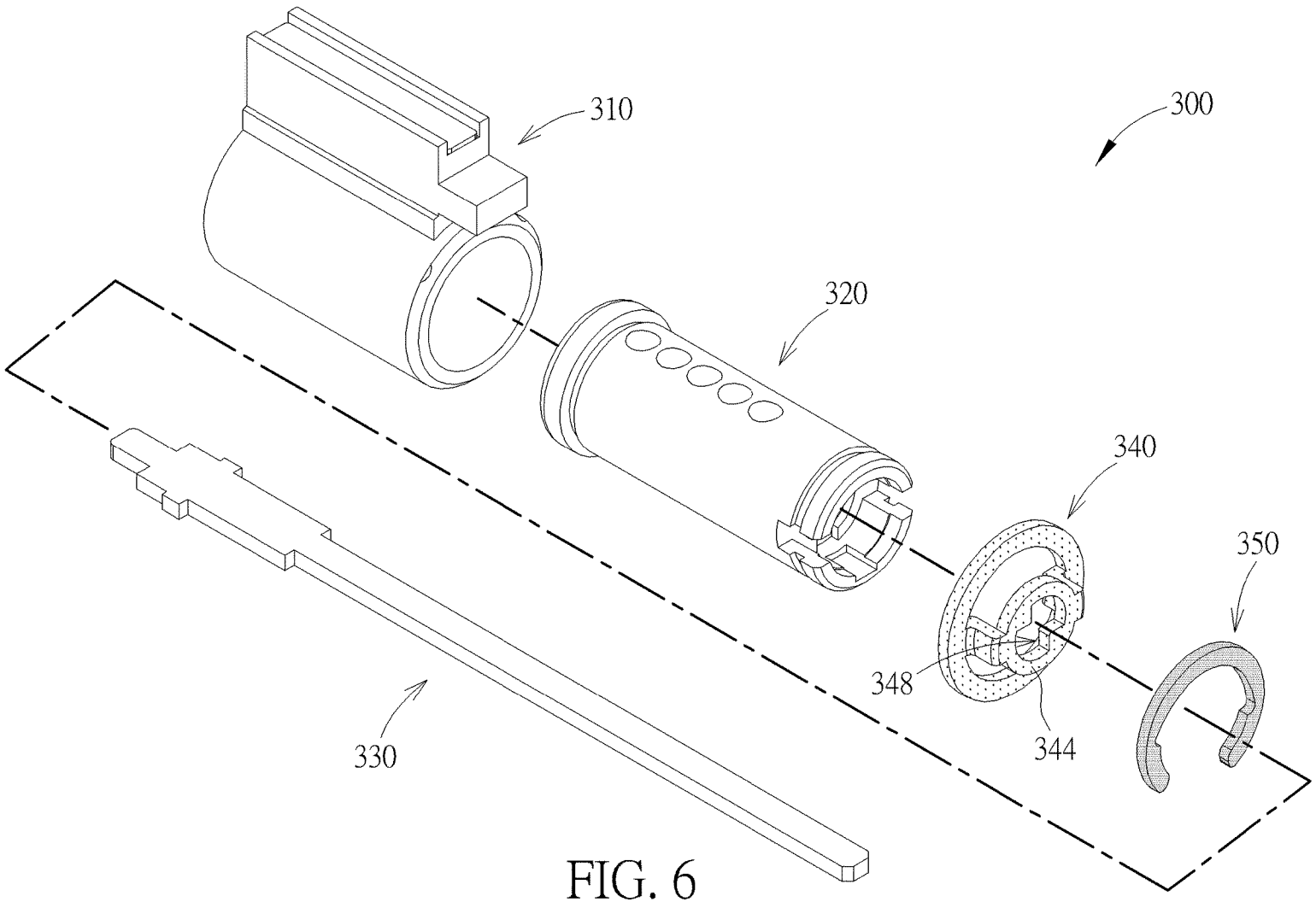
FIG. 6 is an exploded view of the third embodiment of the lock set transmission mechanism of the present invention.

Please refer to FIG. 5 and FIG. 6. FIG. 5 is a diagram showing a third embodiment of the lock set transmission mechanism of the present invention. FIG. 6 is an exploded view of the third embodiment of the lock set transmission mechanism of the present invention. As shown in figures, the third embodiment 300 of the lock set transmission mechanism of the present invention comprises a lock case 310, a lock core 320, a transmission rod 330, a supporting member 340 and a fixing member 350. The lock case 310, the lock core 320, and the fixing member 350 of the third embodiment 300 of the lock set transmission mechanism of the present invention are similar to the lock case 110, the lock core 120, and the fixing member 150 of the first embodiment 100 of the lock set transmission mechanism of the present invention. Therefore, no further illustration is provided. In the present embodiment, the transmission rod 330 is applicable to an L-type lock (lever lock). Similarly, the supporting member 340 can be synchronously rotated with the lock core 320. In addition, a driving structure 348 is formed on a second supporting ring 344 of the supporting member 340 for driving the transmission rod 330 to rotate after the supporting member 340 is rotated relative to the transmission rod 330 by a predetermined angle (such as being rotated by 180 degrees clockwise). In other words, after the lock core 320 is rotated relative to the lock case 310 by the predetermined angle, the driving structure 348 of the supporting member 340 is configured to drive the transmission rod 330 to rotate, in order to move the latch.

Figure 7:
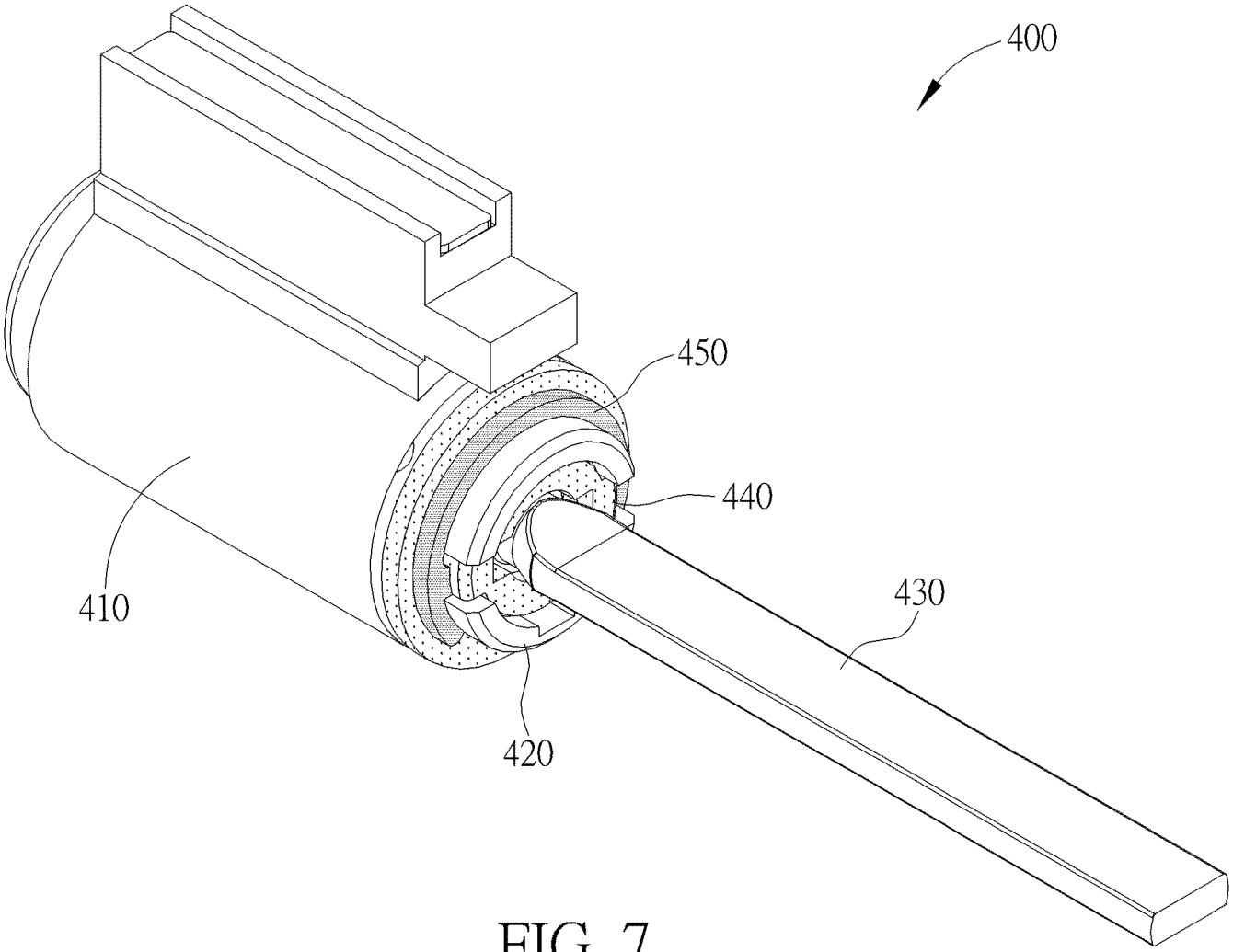
FIG. 7 is a diagram showing a fourth embodiment of the lock set transmission mechanism of the present invention.
Figure 8:
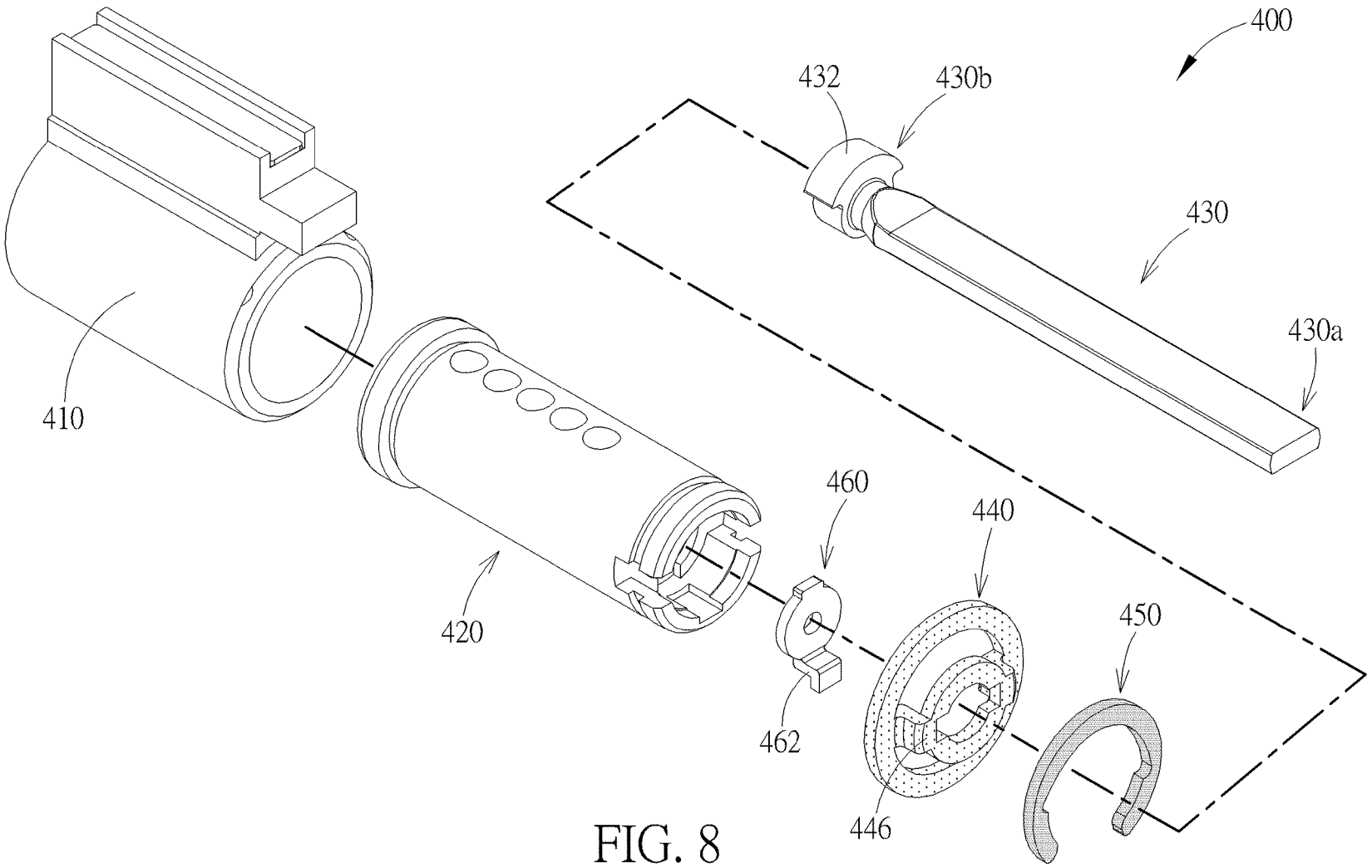
FIG. 8 is an exploded view of the fourth embodiment of the lock set transmission mechanism of the present invention.
Figure 9:
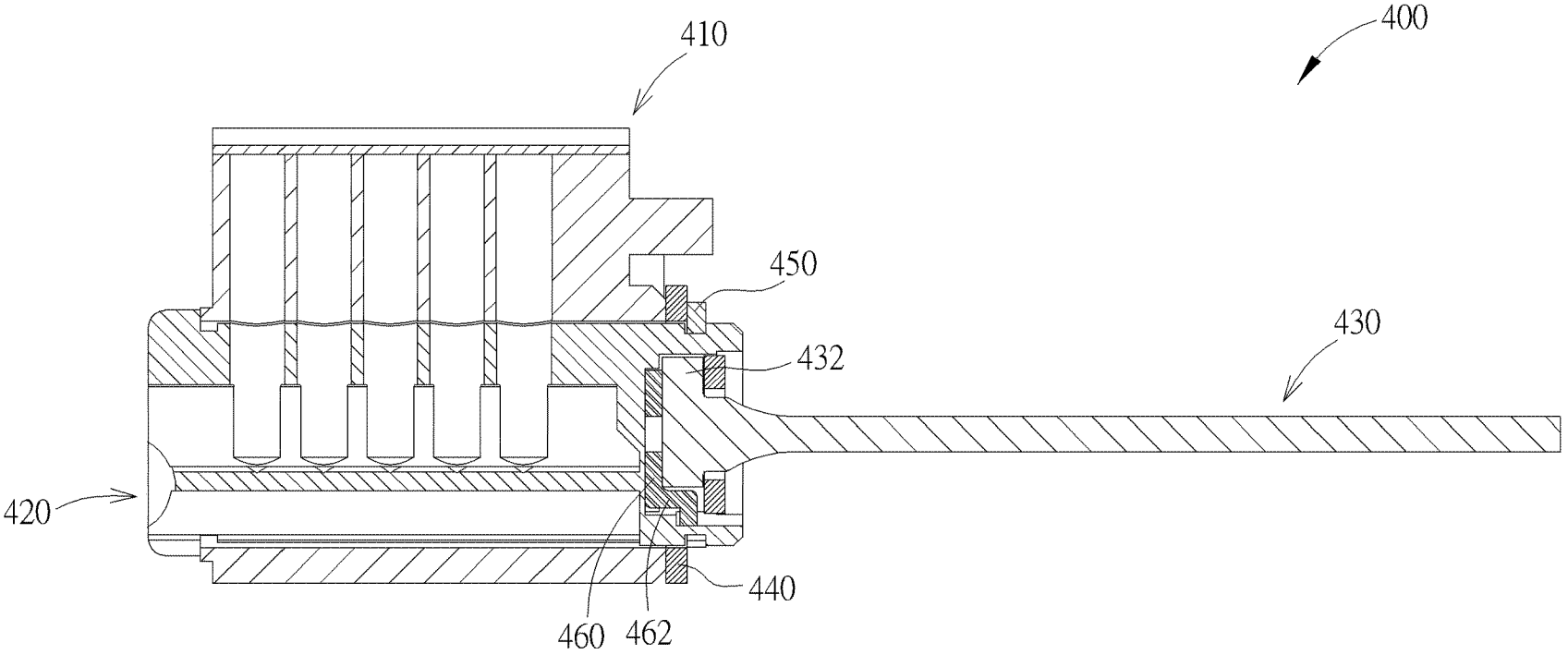
FIG. 9 is a cross-sectional view of the fourth embodiment of the lock set transmission mechanism of the present invention.

Please refer to FIG. 7 to FIG. 9. FIG. 7 is a diagram showing a fourth embodiment of the lock set transmission mechanism of the present invention. FIG. 8 is an exploded view of the fourth embodiment of the lock set transmission mechanism of the present invention. FIG. 9 is a cross-sectional view of the fourth embodiment of the lock set transmission mechanism of the present invention. As shown in figures, the fourth embodiment 400 of the lock set transmission mechanism of the present invention comprises a lock case 410, a lock core 420, a transmission rod 430, a supporting member 440, a fixing member 450 and a washer 460. The lock case 410, the lock core 420, and the fixing member 450 of the fourth embodiment 400 of the lock set transmission mechanism of the present invention are similar to the lock case 110, the lock core 120, and the fixing member 150 of the first embodiment 100 of the lock set transmission mechanism of the present invention. Therefore, no further illustration is provided. In the present embodiment, the transmission rod 430 is applicable to a D-type lock (deadbolt lock). A first end 430*a* of the transmission rod 430 is configured to be connected to a latch (no shown in figures), and a pushed structure 432 is formed on a second end 430*b* of the transmission rod 430. Similarly, the lock core 420 can drive the supporting member 440 to synchronously rotate through supporting ribs 446. In addition, a pushing structure 462 is formed on the washer 460, which is configured to be synchronously rotated with the lock core 420. After the lock core 420 is rotated relative to the lock case 410 by a predetermined angle (such as 90 degrees), the pushing structure 462 of the washer 460 abuts against the pushed structure 432 of the transmission rod 430, in order to push the transmission rod 430 to rotate. In other words, after the lock core 420 is rotated relative to the lock case 410 by the predetermined angle, the pushing structure 462 of the pad 460 is configured to drive the transmission rod 430 to rotate, in order to further move the latch.

Figure 10:
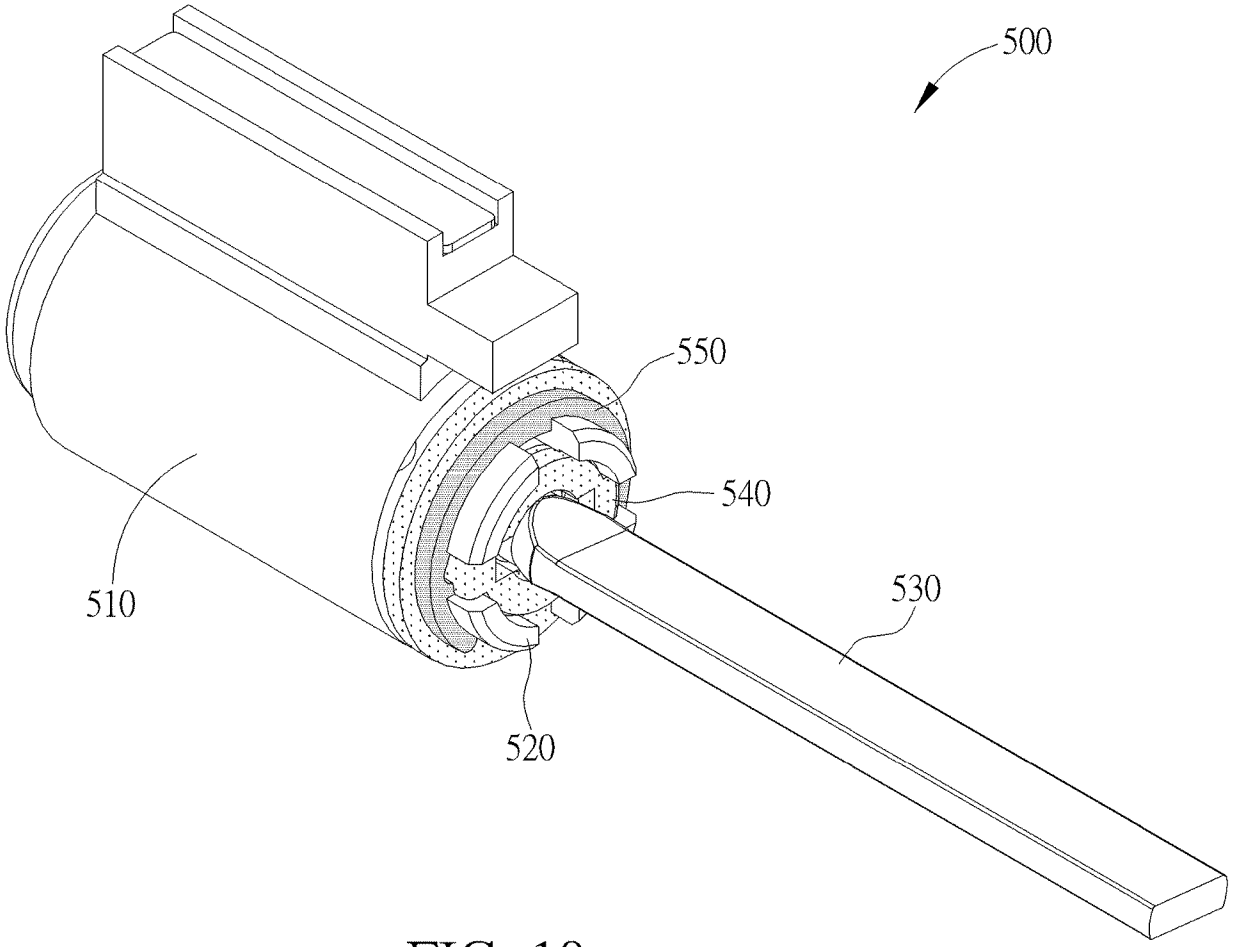
FIG. 10 is a diagram showing a fifth embodiment of the lock set transmission mechanism of the present invention.
Figure 11:
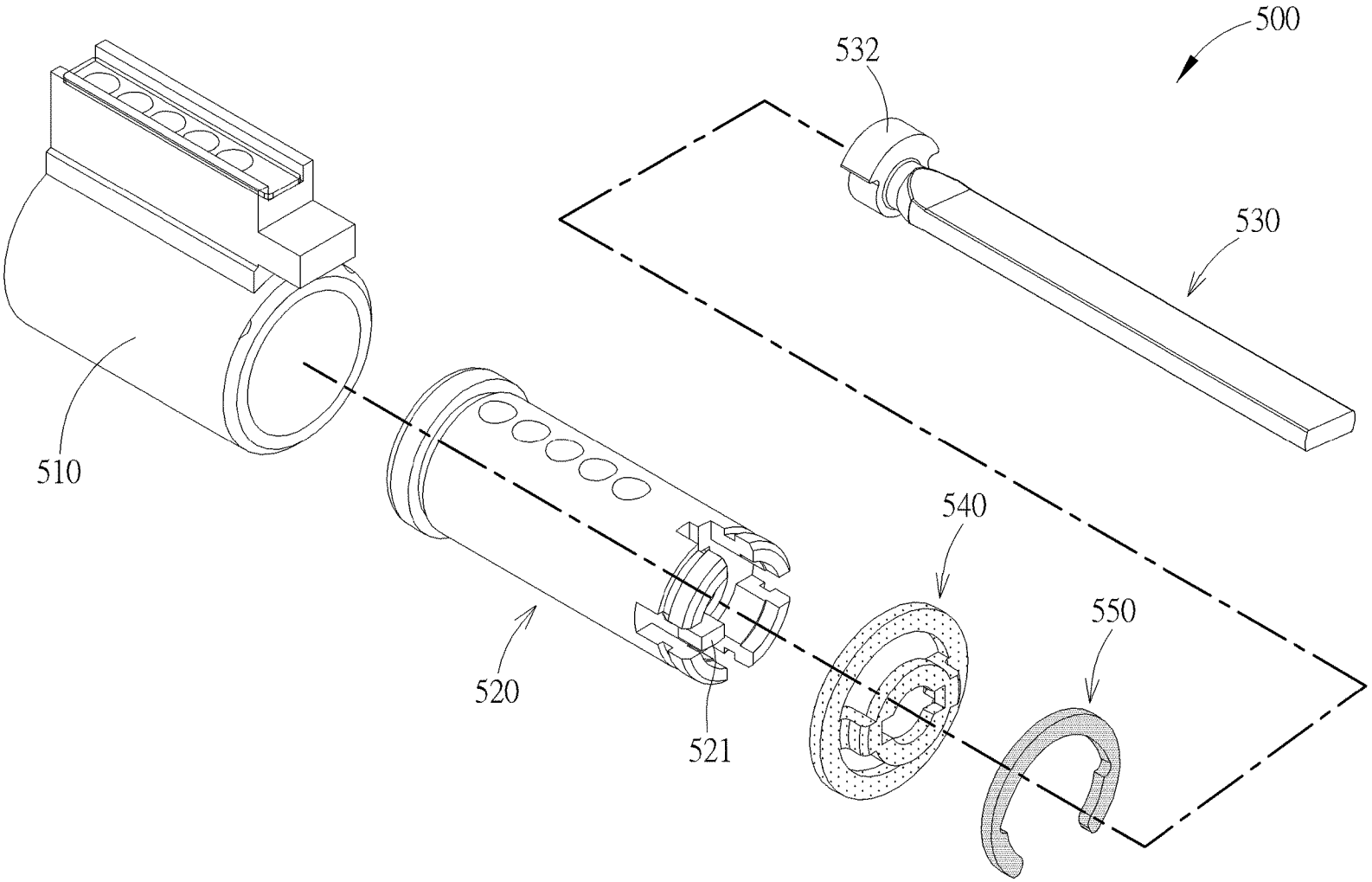
FIG. 11 is an exploded view of the fifth embodiment of the lock set transmission mechanism of the present invention.
Figure 12:
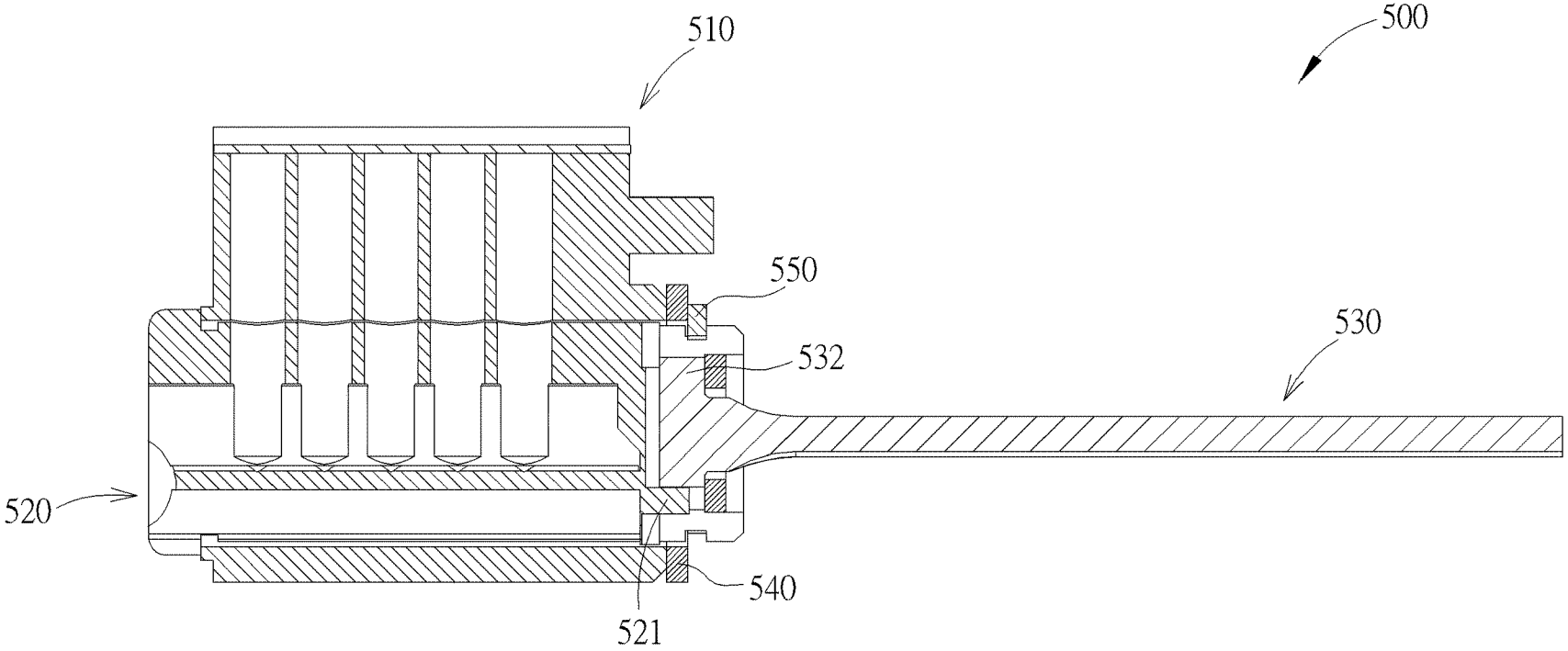
FIG. 12 is a cross-sectional view of the fifth embodiment of the lock set transmission mechanism of the present invention.

Please refer to FIG. 10 to FIG. 12. FIG. 10 is a diagram showing a fifth embodiment of the lock set transmission mechanism of the present invention. FIG. 11 is an exploded view of the fifth embodiment of the lock set transmission mechanism of the present invention. FIG. 12 is a cross-sectional view of the fifth embodiment of the lock set transmission mechanism of the present invention. As shown in figures, the fifth embodiment 500 of the lock set transmission mechanism of the present invention comprises a lock case 510, a lock core 520, a transmission rod 530, a supporting member 540 and a fixing member 550. The lock case 510, the transmission rod 530, the supporting member 540 and the fixing member 550 of the fifth embodiment 500 of the lock set transmission mechanism of the present invention are similar to the lock case 410, the transmission rod 430, the supporting member 440 and the fixing member 450 of the fourth embodiment 400 of the lock set transmission mechanism of the present invention. Therefore, no further illustration is provided. In the present embodiment, the lock core 520 is formed with a pushing structure 521 protruded from a second end of the lock core 520. After the lock core 520 is rotated relative to the lock case 510 by a predetermined angle (such as 90 degrees), the pushing structure 521 of the lock core 520 abuts against a pushed structure 532 of the transmission rod 530, in order to push the transmission rod 530 to rotate. In other words, after the lock core 520 is rotated relative to the lock case 510 by the predetermined angle, the pushing structure 521 of the lock core 520 is configured to drive the transmission rod 530 to rotate, in order to further move the latch.

Figure 13:
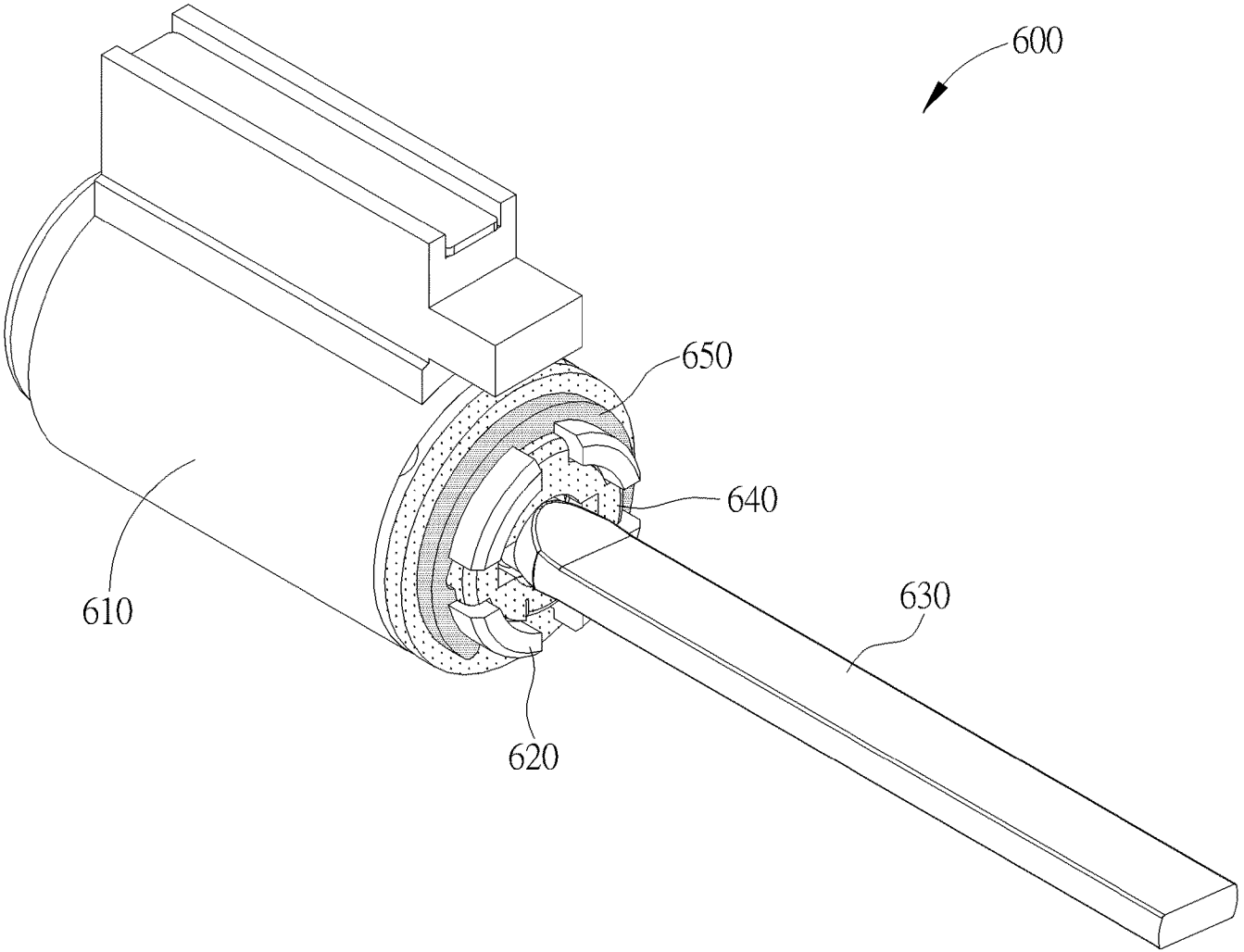
FIG. 13 is a diagram showing a sixth embodiment of the lock set transmission mechanism of the present invention.
Figure 14:
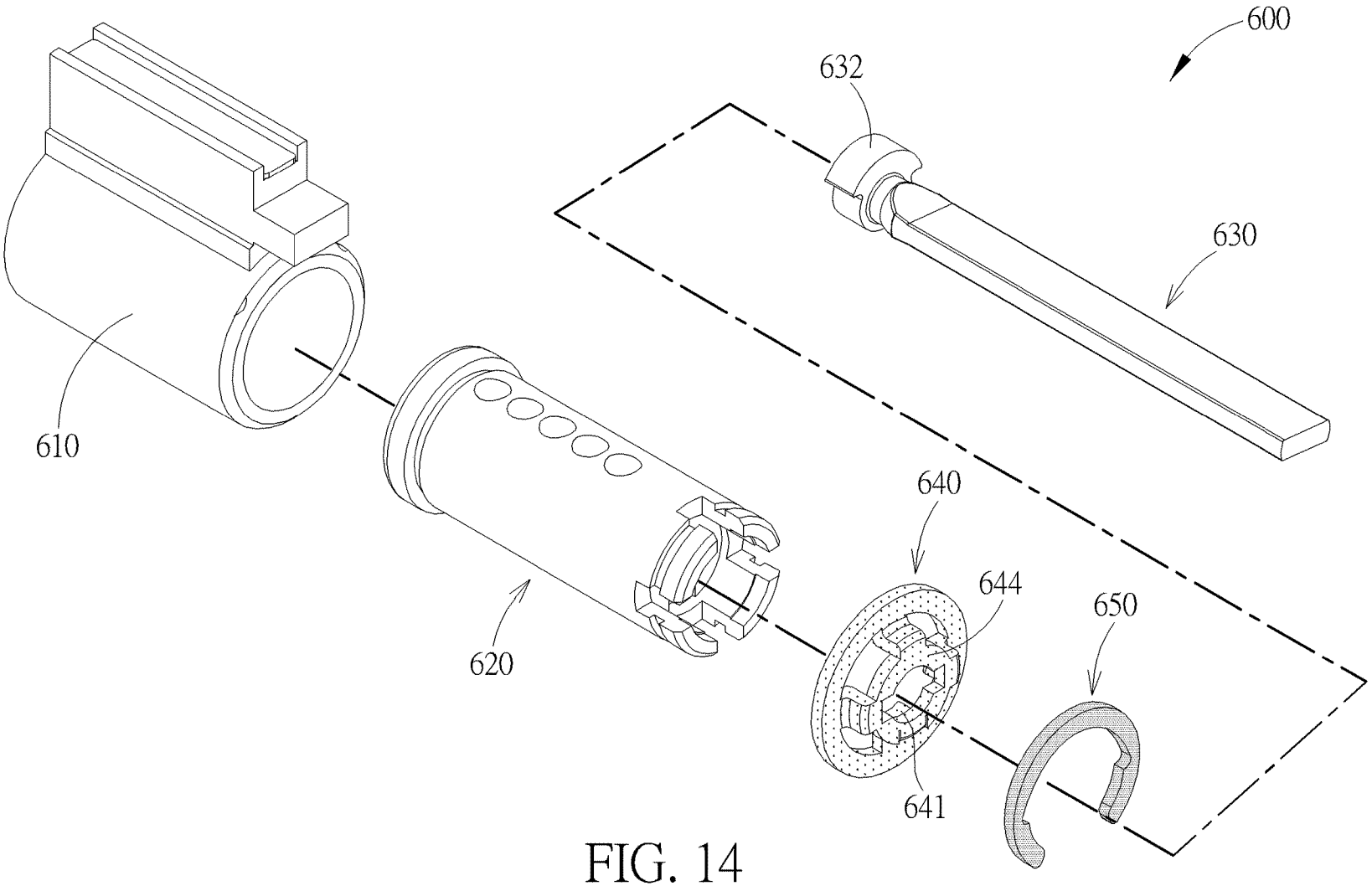
FIG. 14 is an exploded view of the sixth embodiment of the lock set transmission mechanism of the present invention.
Figure 15:
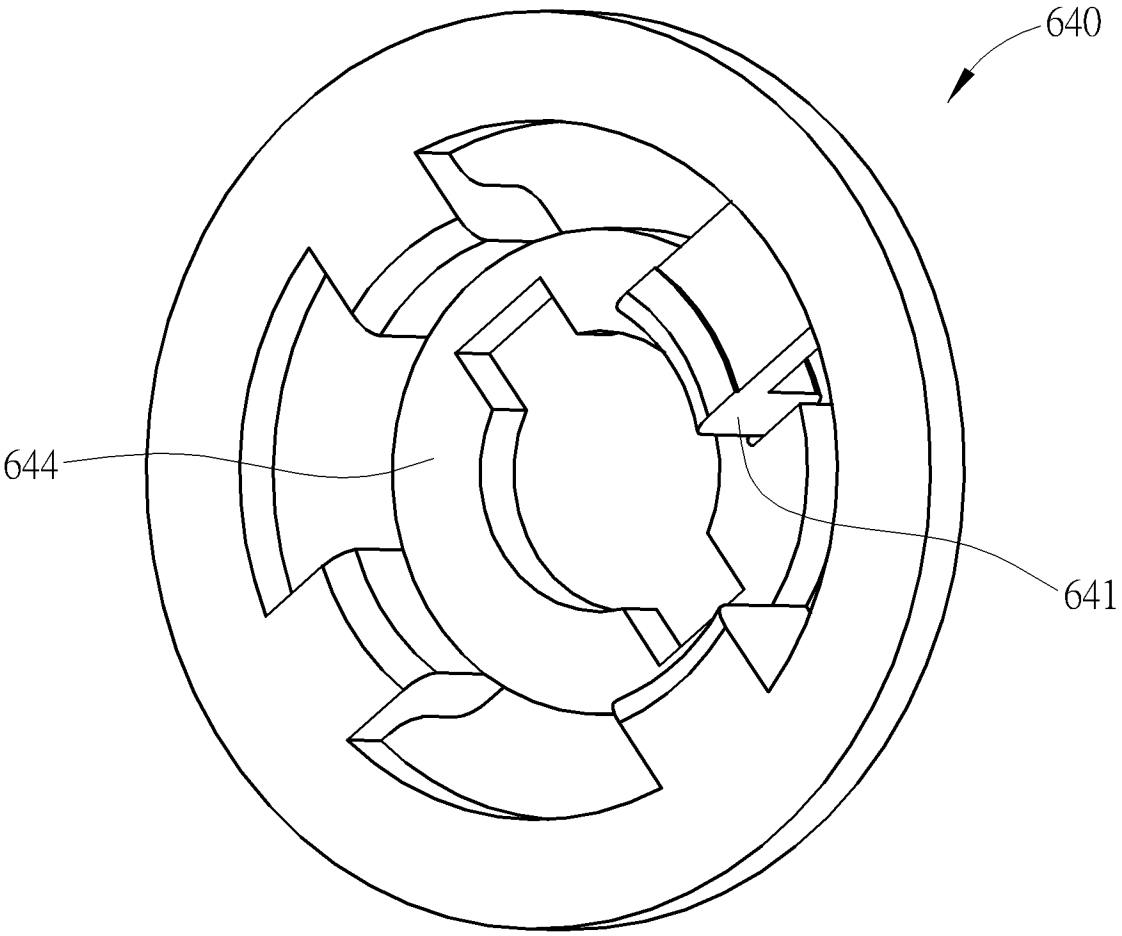
FIG. 15 is a diagram showing a supporting member of FIG. 14 in another angle.
Figure 16:
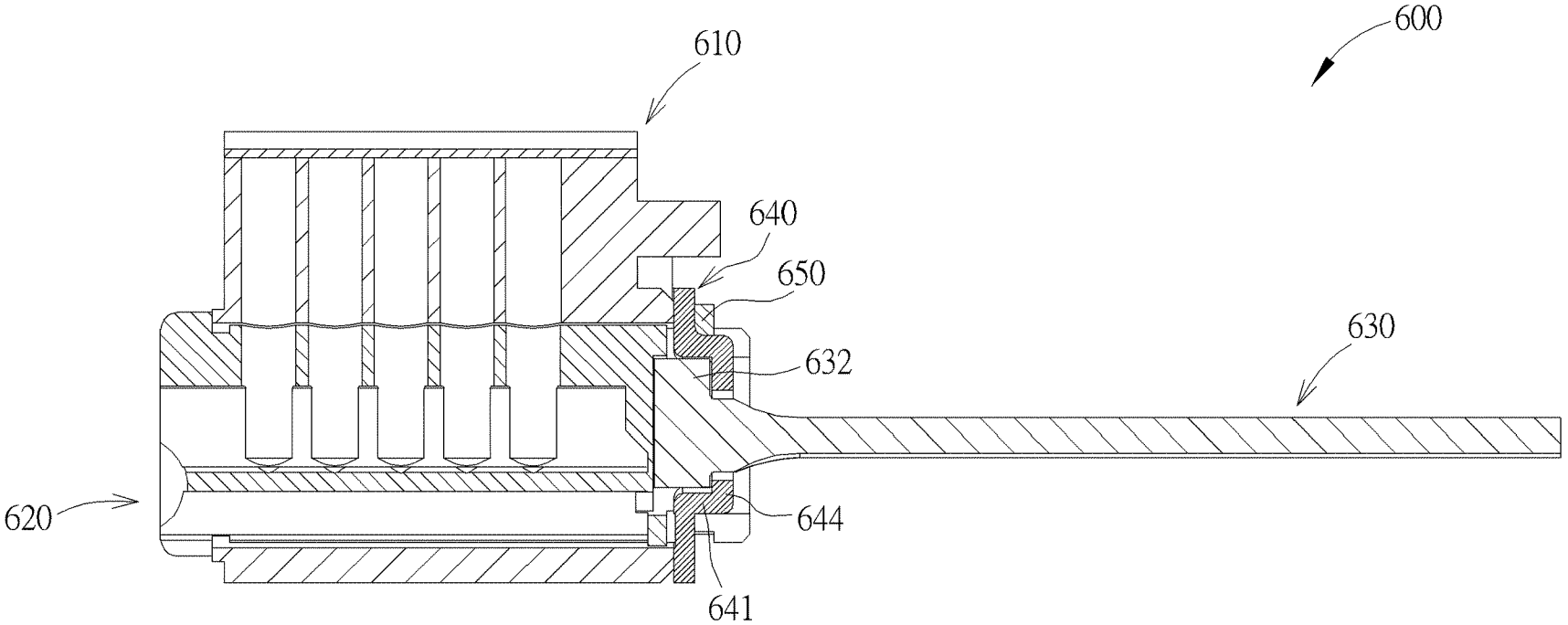
FIG. 16 is a cross-sectional view of the sixth embodiment of the lock set transmission mechanism of the present invention.

Please refer to FIG. 13 to FIG. 16. FIG. 13 is a diagram showing a sixth embodiment of the lock set transmission mechanism of the present invention. FIG. 14 is an exploded view of the sixth embodiment of the lock set transmission mechanism of the present invention. FIG. 15 is a diagram showing the supporting member of FIG. 14 in another angle. FIG. 16 is a cross-sectional view of the sixth embodiment of the lock set transmission mechanism of the present invention. As shown in figures, the sixth embodiment 600 of the lock set transmission mechanism of the present invention comprises a lock case 610, a lock core 620, a transmission rod 630, a supporting member 640 and a fixing member 650. The lock case 610, the transmission rod 630 and the fixing member 650 of the sixth embodiment 600 of the lock set transmission mechanism of the present invention are similar to the lock case 410, the transmission rod 430 and the fixing member 450 of the fourth embodiment 400 of the lock set transmission mechanism of the present invention. Therefore, no further illustration is provided. In the present embodiment, the supporting member 640 is formed with a pushing structure 641 extended from a second supporting ring 644. Orthogonal projection of the pushing structure 641 on the lock core 620 overlaps orthogonal projection of the second supporting ring 644 on the lock core 620. After the lock core 620 is rotated relative to the lock case 610 by a predetermined angle (such as 90 degrees), the pushing structure 641 of the supporting member 640 abuts against a pushed structure 632 of the transmission rod 630, in order to push the transmission rod 630 to rotate. In other words, after the lock core 620 is rotated relative to the lock case 610 by the predetermined angle, the pushing structure 641 of the supporting member 640 is configured to drive the transmission rod 630 to rotate, in order to further move the latch.

Figure 17:
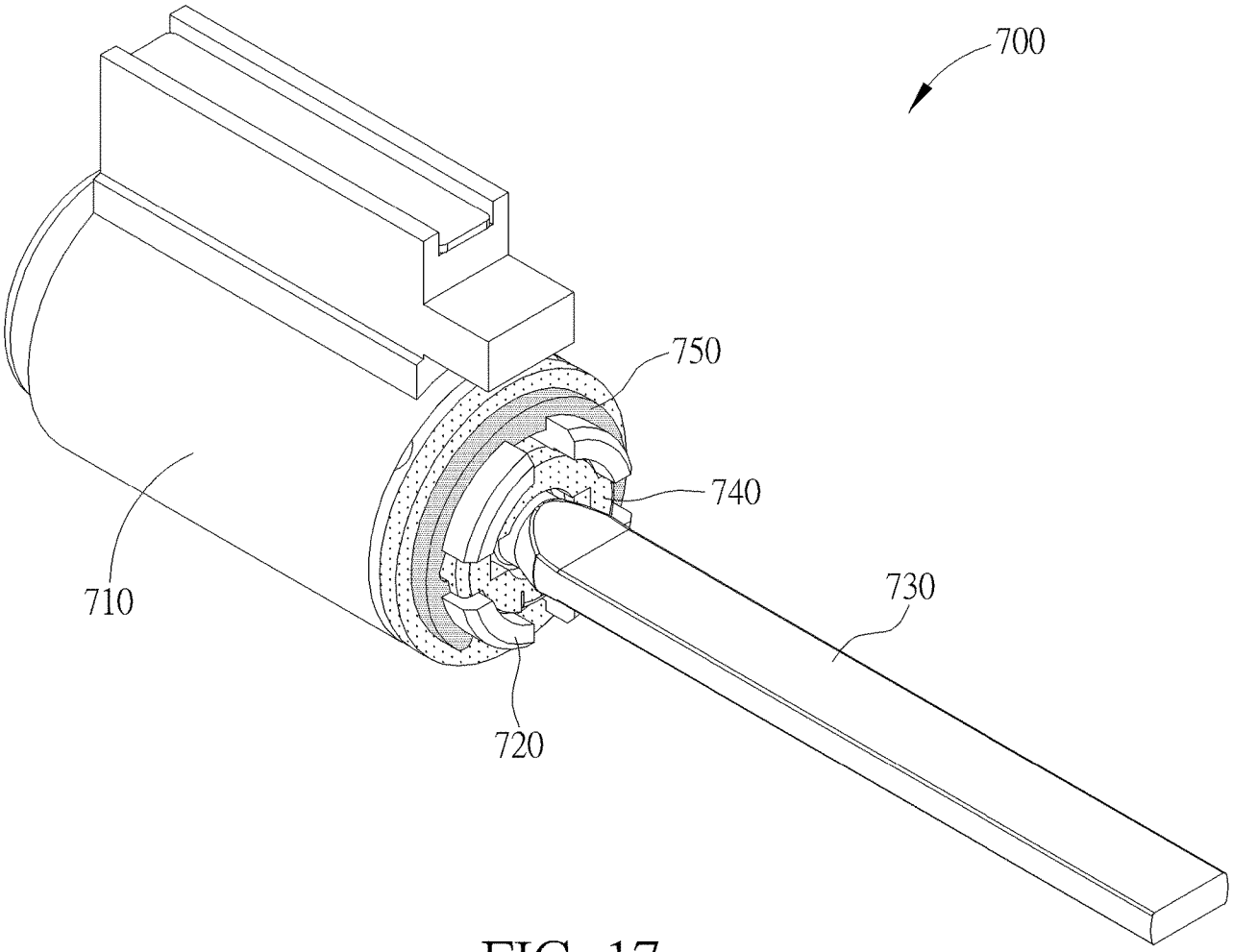
FIG. 17 is a diagram showing a seventh embodiment of the lock set transmission mechanism of the present invention.
Figure 18:
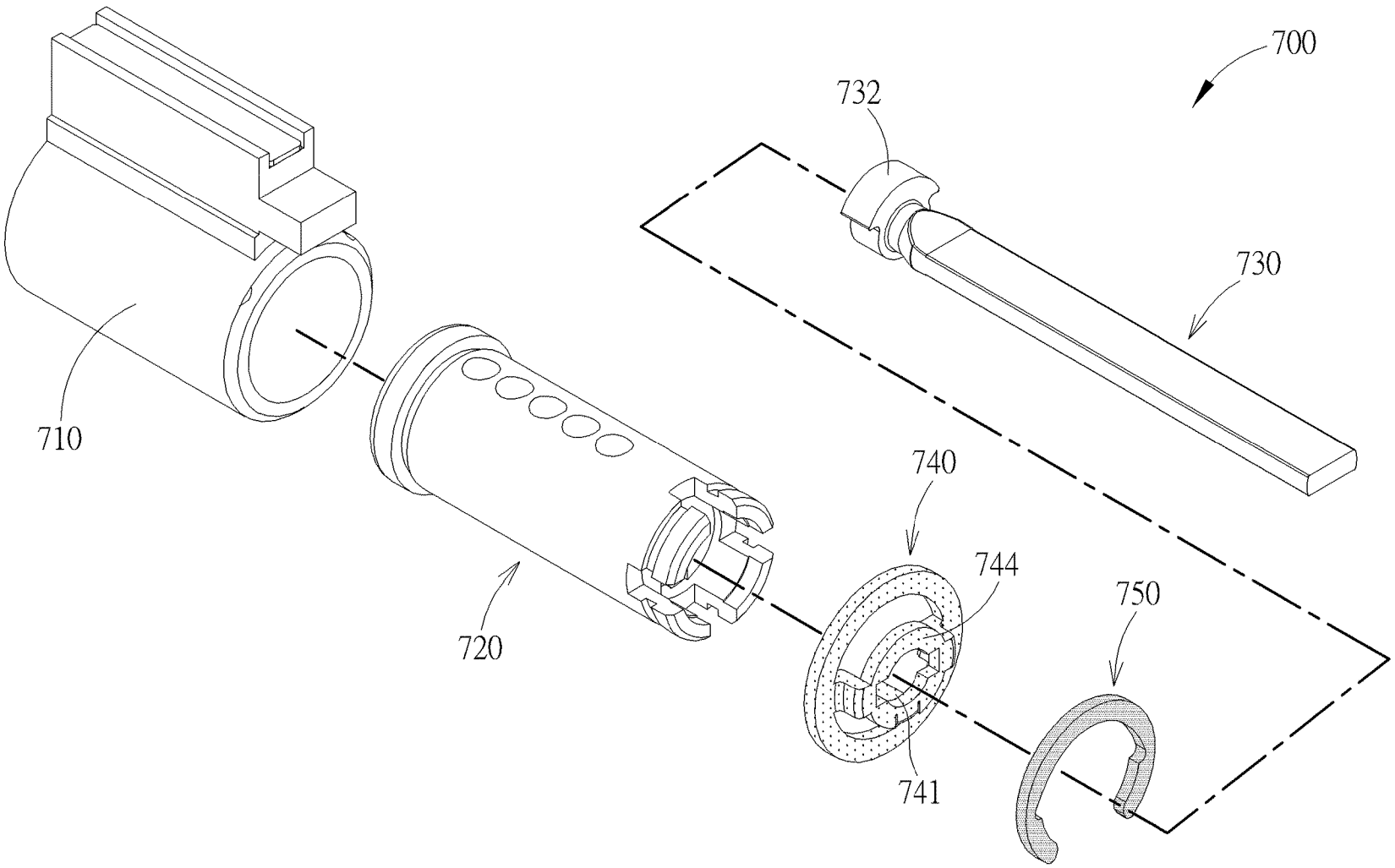
FIG. 18 is an exploded view of the seventh embodiment of the lock set transmission mechanism of the present invention.
Figure 19:
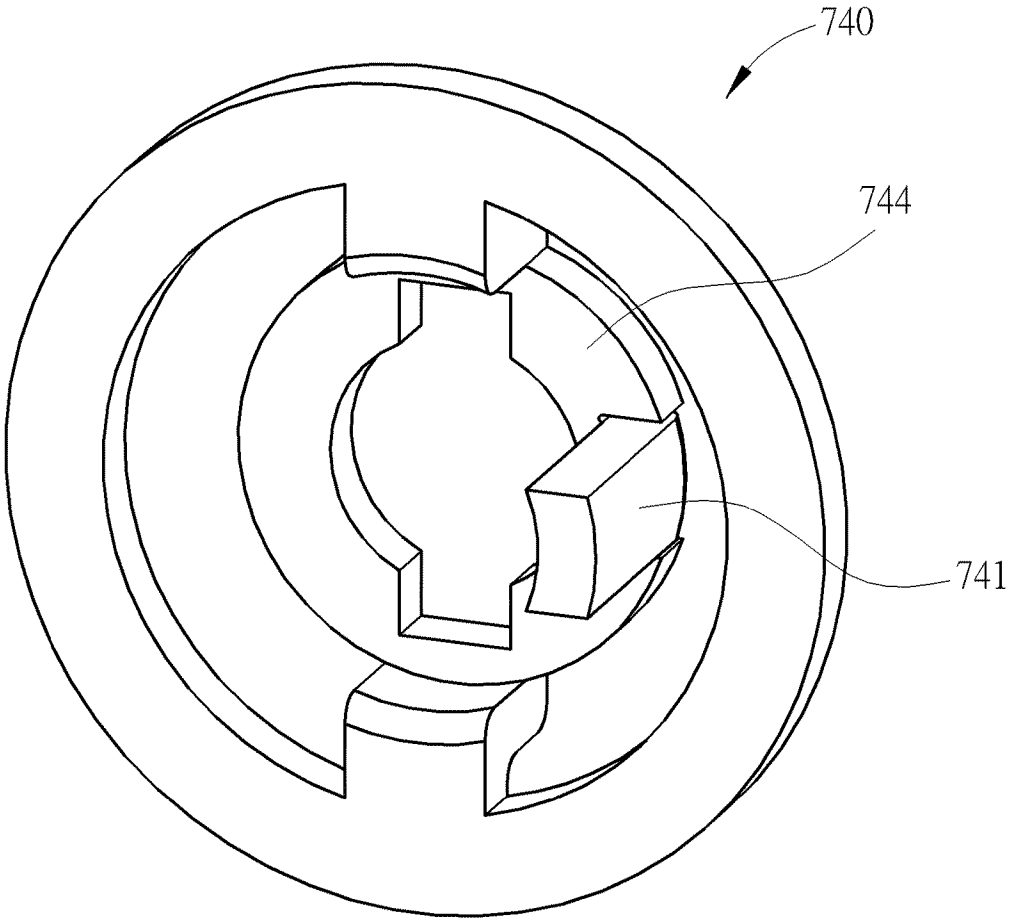
FIG. 19 is a diagram showing the supporting member of FIG. 18 in another angle.
Figure 20:
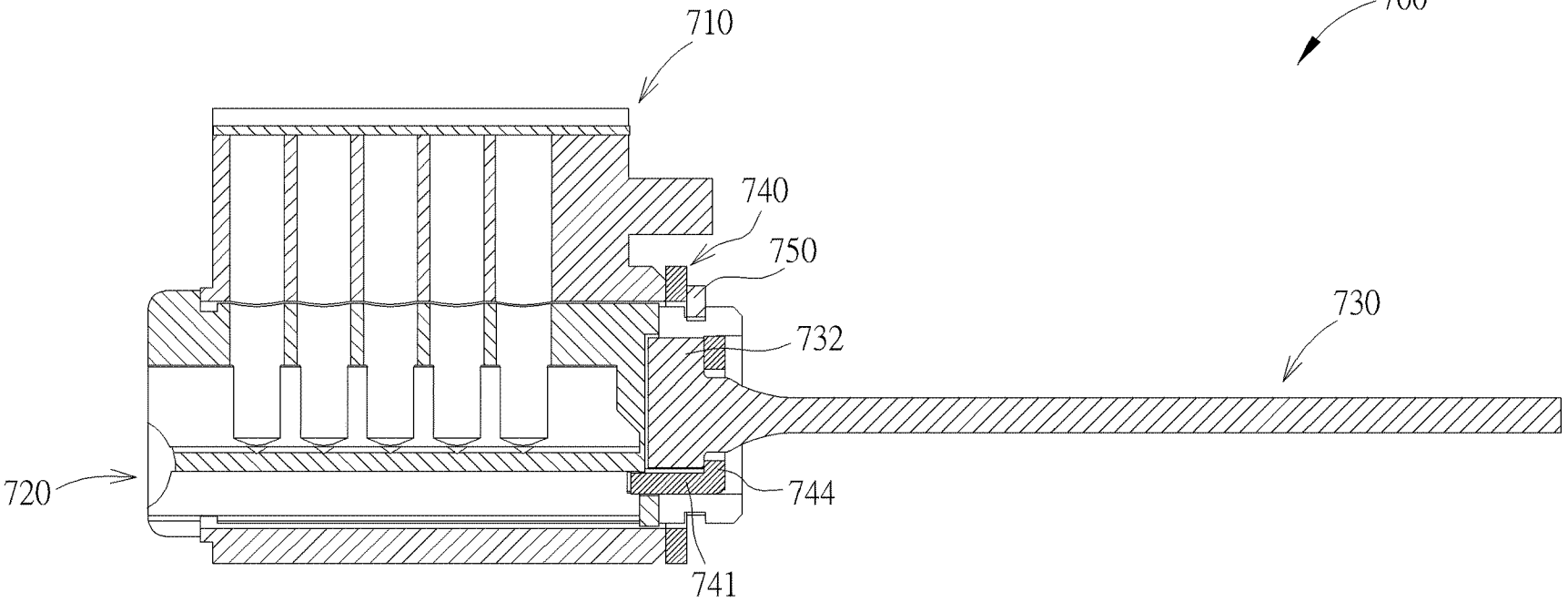
FIG. 20 is a cross-sectional view of the seventh embodiment of the lock set transmission mechanism of the present invention.

Please refer to FIG. 17 to FIG. 20. FIG. 17 is a diagram showing a seventh embodiment of the lock set transmission mechanism of the present invention. FIG. 18 is an exploded view of the seventh embodiment of the lock set transmission mechanism of the present invention. FIG. 19 is a diagram showing the supporting member of FIG. 18 in another angle. FIG. 20 is a cross-sectional view of the seventh embodiment of the lock set transmission mechanism of the present invention. As shown in figures, the seventh embodiment 700 of the lock set transmission mechanism of the present invention comprises a lock case 710, a lock core 720, a transmission rod 730, a supporting member 740 and a fixing member 750. The lock case 710, the transmission rod 730 and the fixing member 750 of the seventh embodiment 700 of the lock set transmission mechanism of the present invention are similar to the lock case 410, the transmission rod 430 and the fixing member 450 of the fourth embodiment 400 of the lock set transmission mechanism of the present invention. Therefore, no further illustration is provided. In the present embodiment, the supporting member 740 is formed with a pushing structure 741 extended from a second supporting ring 744 and inserted into the lock core 720. After the lock core 720 is rotated relative to the lock case 710 by a predetermined angle (such as 90 degrees), the pushing structure 741 of the supporting member 740 abuts against a pushed structure 732 of the transmission rod 730, in order to drive the transmission rod 730 to rotate. In other words, after the lock core 720 is rotated relative to the lock case 710 by the predetermined angle, the pushing structure 741 of the supporting member 740 is configured to drive the transmission rod 730 to rotate, in order to further move the latch.

In summary, in the first embodiment to the fourth embodiment of the lock set transmission mechanism of the present invention, the same lock core can drive the transmission rods of different types of lock sets through the supporting member or the washer. In addition, in the fourth embodiment to the seventh embodiment of the lock set transmission mechanism of the present invention, the transmission rods of the same type of the lock sets can be driven by different lock cores through the supporting member or the washer.

In contrast to the prior art, the lock core of the lock set transmission mechanism of the present invention can cooperate with different transmission rods through the corresponding supporting members, in order to form different types of lock sets. Moreover, the transmission rods of the same type of lock sets can cooperate with different lock cores through the corresponding supporting members. Therefore, the lock set transmission mechanism of the present invention has greater design flexibility and production efficiency.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A lock set transmission mechanism, comprising:

a lock case;

a lock core arranged on the lock case and configured to be driven by a key to rotate relative to the lock case;

a transmission rod having a first end and a second end, the first end configured to be connected to a latch;

a supporting member, comprising:

a first supporting ring sleeved on the lock core;

a second supporting ring configured to support the second end of the transmission rod; and at least one supporting rib with two opposite ends respectively connected to the first supporting ring and the second supporting ring; and a fixing member configured to fix the supporting member to the lock core;

wherein when the lock core is rotated relative to the lock case, the transmission rod is driven by the lock core to rotate, in order to move the latch.

2. The lock set transmission mechanism of claim 1, wherein a groove is formed on the lock core, the fixing member is a C-shaped ring engaged with the groove and abutting against the first supporting ring.

3. The lock set transmission mechanism of claim 1, wherein at least one recessed structure is formed on the lock core, the at least one supporting rib is accommodated in the at least one recessed structure.

4. The lock set transmission mechanism of claim 1, wherein a driving structure is formed on the second supporting ring of the supporting member, and configured to drive the transmission rod to synchronously rotate with the lock core.

5. The lock set transmission mechanism of claim 1, wherein a driving structure is formed on the second supporting ring of the supporting member, and configured to drive the transmission rod to rotate after the lock core is rotated relative to the lock case by a predetermined angle.

6. The lock set transmission mechanism of claim 1, wherein a pushed structure is formed on the second end of the transmission rod, a pushing structure is formed on the lock core; when the lock core is rotated relative to the lock case, the pushing structure of the lock core abuts against the pushed structure of the transmission rod to further drive the transmission rod to rotate.

7. The lock set transmission mechanism of claim 1, further comprising a washer arranged on the lock core, wherein a pushed structure is formed on the second end of the transmission rod, a pushing structure is formed on the washer; when the lock core is rotated relative to the lock case, the pushing structure of the washer abuts against the pushed structure of the transmission rod to further drive the transmission rod to rotate.

8. The lock set transmission mechanism of claim 1, wherein a pushed structure is formed on the second end of the transmission rod, a pushing structure is formed on the supporting member; when the lock core is rotated relative to the lock case, the pushing structure of the supporting member abuts against the pushed structure of the transmission rod to further drive the transmission rod to rotate.

9. The lock set transmission mechanism of claim 8, wherein the pushing structure of the supporting member is extended from the second supporting ring to be inserted into the lock core.

10. The lock set transmission mechanism of claim 8, wherein the pushing structure of the supporting member is extended from the second supporting ring, and orthogonal projection of the pushing structure on the lock core overlaps orthogonal projection of the second supporting ring on the lock core.

11. The lock set transmission mechanism of claim 1, comprising a mounting kit, the mounting kit comprising the transmission rod, the supporting member comprising the at least one supporting rib and a driving structure, the driving structure being formed on the second supporting ring of the supporting member, the lock set transmission mechanism further comprising an auxiliary mounting kit, the auxiliary mounting kit comprising:

an auxiliary transmission rod having a first end and a second end;

an auxiliary supporting member, comprising:

a first auxiliary supporting ring;

a second auxiliary supporting ring; and at least one auxiliary supporting rib connected to the first auxiliary supporting ring and the second auxiliary supporting ring; and an auxiliary driving structure formed on the second auxiliary supporting ring of the auxiliary supporting member;

wherein the fixing member is configured to fix the supporting member or the auxiliary supporting member to the lock core;

wherein when the lock core is mounted to the mounting kit, the first supporting ring of the supporting member is sleeved on the lock core, the first end of the transmission rod is connected to a latch, and the second end of the transmission rod is mounted to the driving structure;

wherein when the lock core is mounted to the auxiliary mounting kit, the first auxiliary supporting ring of the auxiliary supporting member is sleeved on the lock core, the first end of the auxiliary transmission rod is connected to the latch, and the second end of the auxiliary transmission rod is mounted to the auxiliary driving structure;

wherein the lock core is selectively mounted to the mounting kit or the auxiliary mounting kit.

12. The lock set transmission mechanism of claim 11, wherein a shape of the driving structure is different from a shape of the auxiliary driving structure.

* * * * *